United States Patent [19]

Morgan, Jr.

[11] 4,445,453

[45] May 1, 1984

[54] HIGH SPEED DISPLACEMENT TYPE HULL

[75] Inventor: Albert E. Morgan, Jr., Honolulu, Hi.

[73] Assignee: Hiram L. Fong, Jr., Honolulu, Hi. ; a part interest

[21] Appl. No.: 359,185

[22] Filed: Mar. 17, 1982

[51] Int. Cl.[3] ..... B63B 1/32

[52] U.S. Cl. ..... 114/290; 114/56; 114/274; 114/288; 114/289

[58] Field of Search ..... 114/56, 274, 283, 288, 114/289, 290

[56] References Cited

U.S. PATENT DOCUMENTS

| | | | |
|---|---|---|---|
| 2,020,792 | 11/1935 | Maynard et al. | 114/290 |
| 2,474,667 | 6/1949 | Harvey | 114/290 |
| 3,223,066 | 12/1965 | Irving | 114/290 |
| 3,702,598 | 11/1972 | Szptyman | 114/289 |
| 3,762,355 | 10/1973 | Raynes | 114/283 |
| 3,807,337 | 4/1974 | English et al. | 114/56 |
| 4,263,866 | 4/1981 | Shirley | 114/56 |

*Primary Examiner*—Trygve M. Blix
*Assistant Examiner*—Ivy M. Shum
*Attorney, Agent, or Firm*—Harvey B. Jacobson

[57] ABSTRACT

A hull is provided including opposite longitudinal upstanding outer sides and a central depending longitudinal displacement-type keel. The forward ends portions of the outer sides and the keel curve inwardly and upwardly, respectively, and merge to form a forwardly and upwardly tapering bow. The lower portions of the sides, rearward of the bow, terminate downwardly in downwardly and outwardly inclined outer side surfaces of opposite side downwardly and outwardly inclined displacement-type cutwaters whose lower marginal portions are rearwardly and downwardly inclined. The cutwaters include inwardly and upwardly inclined inner side surfaces extending longitudinally thereof and which diverge upwardly away from the corresponding outer side surfaces. The keel, rearward of the bow, includes a rearwardly and downwardly inclined lower extremity extending longitudinally of the hull throughout a major portion of the length of the keel rearward of the bow and upstanding opposite side surfaces spaced inwardly of said inner side surfaces of said cutwaters. Generally semi-cylindrical downwardly opening tunnel roof surfaces disposed on opposite sides of the keel and extending longitudinally of the hull bridge and interconnect the upper marginal portions of corresponding inner side surfaces of the cutwaters and side surfaces of the keel. The tunnel roof surfaces include upper portions which are substantially horizontally disposed.

9 Claims, 4 Drawing Figures

HIGH SPEED DISPLACEMENT TYPE HULL

BACKGROUND OF THE INVENTION

There are various types of hulls which have been proposed for high speed operation. Planing hulls are the most well known hulls for high speed operation, but planing hulls are limited to hulls smaller than the minimum desired length of hulls which may be used for extended military operations. In addition, some high speeds are equipped with water foils, but water foil equipped hulls may not readily navigate at speed in heavy seas.

In addition, platform-type vessels using two or more fully or partially submerged displacement hulls are enjoying considerable development toward the production of a high speed hull which may be used for military purposes, but these platform-type vessels have a tendency to ride along a path which generally parallels the surface of the body of water in which they are operating and thus tend not to be operational at speed in seas which include large swells. A platform vessel moving downwardly along the descending side of a large ocean swell tends to continue moving downwardly in the same general path when the platform vessel reaches the bottom of the swell.

Finally, conventional displacement-type monohulls are limited in speed and tend to pound in heavy seas.

Accordingly, a need exists for an improved form of relatively large displacement-type hulls which may be utilized as military vessels and yet which may have the capability of operating as a displacement-type hull at high speeds under widely varying sea conditions.

BRIEF DESCRIPTION OF THE INVENTION

The hull of the instant invention includes opposite side downwardly and outwardly inclined cutwaters, a central depending keel and downwardly opening generally semi-cylindrical generally horizontal tunnel ceiling surfaces joining the upper marginal portions of the opposite sides of the center keel and the inner sides of the downwardly and outwardly inclined cutwaters. The lower extremities of the central keel and opposite side cutwaters are inclined rearwardly and downwardly throughout major length portions thereof. The hull may have various different forms of propulsion including jet propulsion, water jet propulsion and marine propeller drive.

The main object of this invention is to provide an improved large displacement-type hull suitable for military usage and which may be operated at high speed in widely varying sea conditions.

Another object of this invention is to provide an improved form of hull whose bottom surfaces will provide improved roll and pitch stability and afford high maneuverability in varying sea conditions.

Still another object of this invention is to provide a displacement type hull in accordance with the preceding objects and which will be operational at relatively high speeds even though a displacement-type hull is provided.

Another very important object of this invention is to provide a hull of increased stability whereby the landing of aircraft thereon and the firing of defensive as well as offensive weapons therefrom may be effected with greater accuracy.

Still another object of this invention is to provide an improved form of hull for military usage which will enable operation at higher speeds and at greater fuel economy than usually associated with displacement-type hulls.

A further object of this invention is to provide an improved form of hull which may include various different forms of propulsion for movement at speed while functioning as a displacement hull.

A final object of this invention to be specifically enumerated herein is to provide an improved hull construction in accordance with preceding objects and which will conform to conventional forms of manufacture, and dependable in operation so as to provide a device that will be economically feasible, long lasting and capable of operation as designed for extended periods of time.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
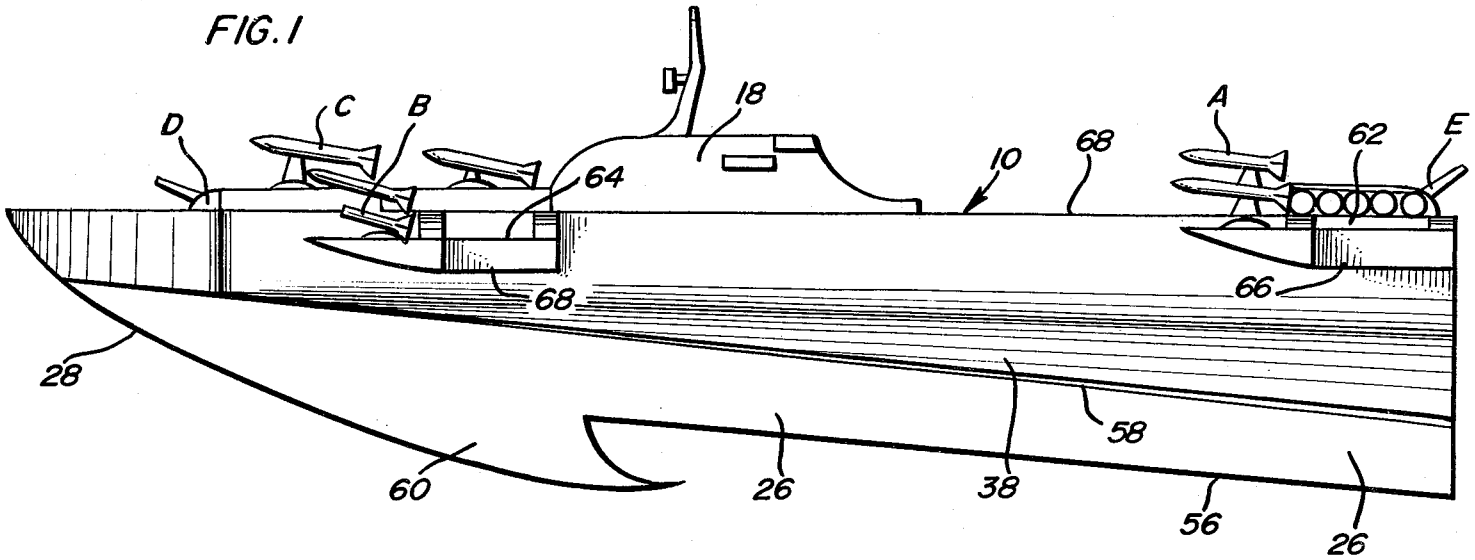
FIG. 1 is a side elevational view of the hull of the instant invention.

Referring now more specifically to the drawings, the numeral 10 generally designates the displacement-type hull of the instant invention. The hull 10 includes opposite sides 12 and 14 interconnected along the upper marginal portions by a main deck 16 upon which suitable superstructure 18 may be disposed. The lower marginal portions of the sides 12 and 14 curve outwardly as at 22 and 24 for purposes to be hereinafter more fully set forth and it may be seen from FIGS. 1, 3 and 4 of the drawings that the hull 10 includes a central depending displacement-type keel 26. The forward end of the keel 26 curves upwardly as at 28 and the forward ends of the sides 12 and 14 are forwardly convergent as at 32 and 34 to define a forwardly tapering bow 36. The lower portions 22 and 24 of the sides 12 and 14 define the outer surfaces of downwardly and outwardly inclined cutwaters 38 and 40 spaced outwardly of the keel 26 and the cutwaters 38 and 40 include inner upwardly and inwardly inclined surfaces 42 and 44 which diverge upwardly relative to the corresponding lower outer surface portions 22 and 24.

A pair of downwardly opening and generally horizontal semi-cylindrical tunnel ceiling or roof surfaces 46 and 48 join the upper marginal portions of the inner sides or surfaces 42 and 44 and the upper marginal portions of the opposite sides surfaces 50 and 52 of the keel 26. The ceiling or roof surfaces 44 and 46 are disposed slightly below the static water level 54 of the hull 10.

As may best be seen from FIG. 1 of the drawings, the lower extremities of the cutwaters 38 and 40 are continuously rearwardly and downwardly inclined. Further, the aft portion of the lower extremity of the keel 26 is rearwardly and downwardly inclined as at 56 with the rearward and downward inclination of the aft portion of the keel 26 being at least substantially equal to the rearward and downward inclination of the lower extremities of the cutwaters 38 and 40 at 58.

In order to provide sufficient positive buoyancy to the forepart of the hull 10, the forward end of the keel 26 includes a depending fin portion 60. The depending fin portion 60 facilitates prevention of the bow 36 tending to bury itself when bottoming in a trough of a heavy swell and the rearwardly and downwardly inclined lower extremities 56 and 58 of the keel 26 and the cutwaters 38 and 40 provides additional position buoyancy to the rear of the hull 10 and thus enables the hull 10 to move through the water with rear mounted propulsion without depressing the sterm of the hull 10.

Any suitable form of propulsion such as conventional jet, water jet and marine propeller propulsion may be used on the hull 10. Further, various means of steering the hull may be provided including a horizontally swingable rudder (not shown) built into the aft portion of the keel 26 and/or each cutwater 38 and 40. Of course, marine screw propulsion units may be disposed in the aft portion of the tunnels defined on either side of the keel 26 inward of the cutwaters 38 and 40.

Figure 3:
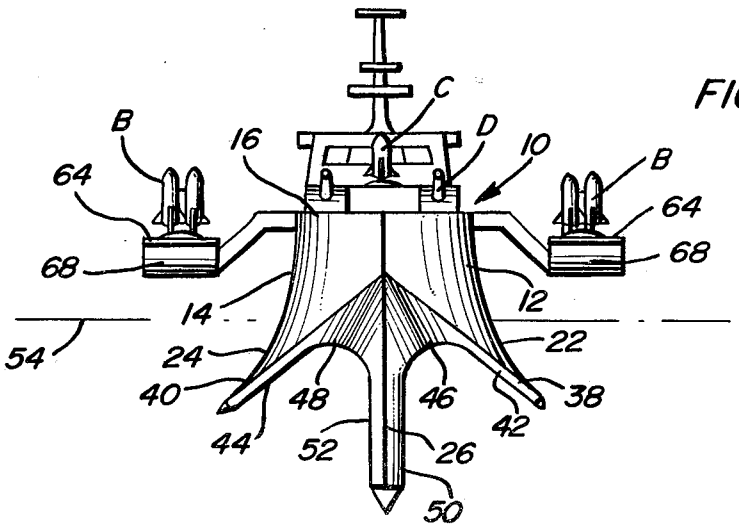
FIG. 3 is a front elevational view of the hull.
Figure 2:
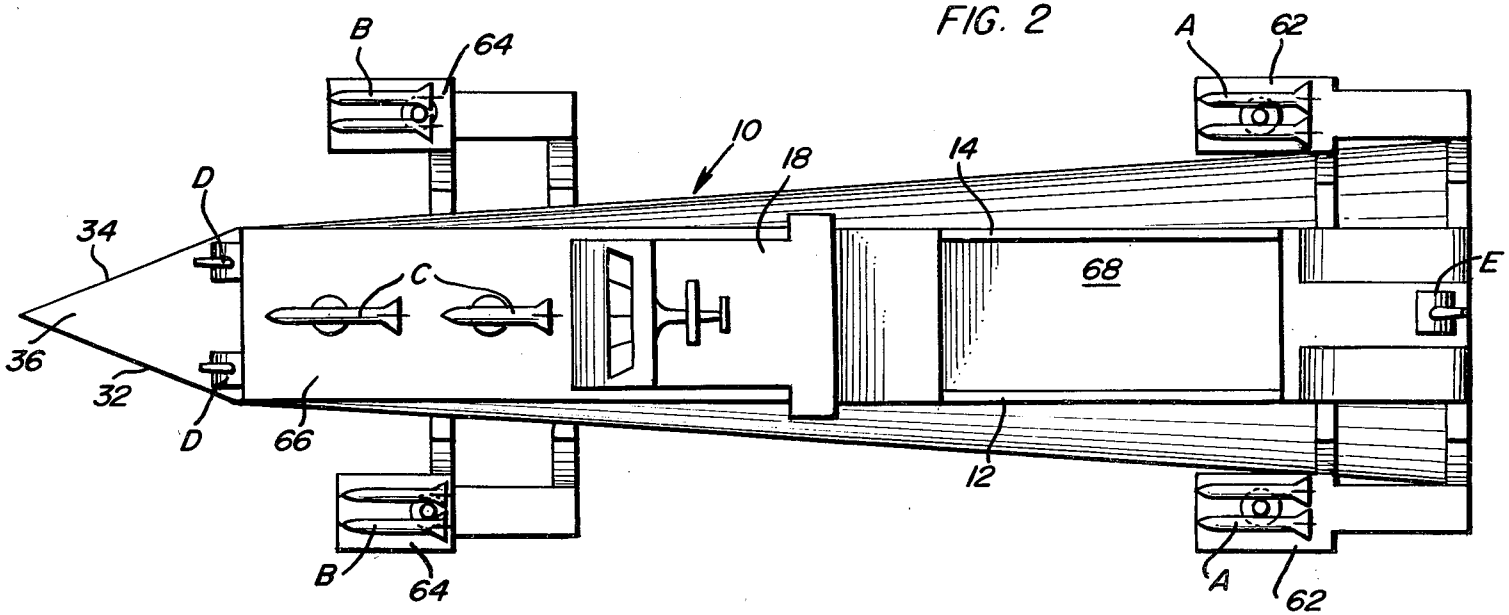
FIG. 2 is a top plan view of the hull.
Figure 4:
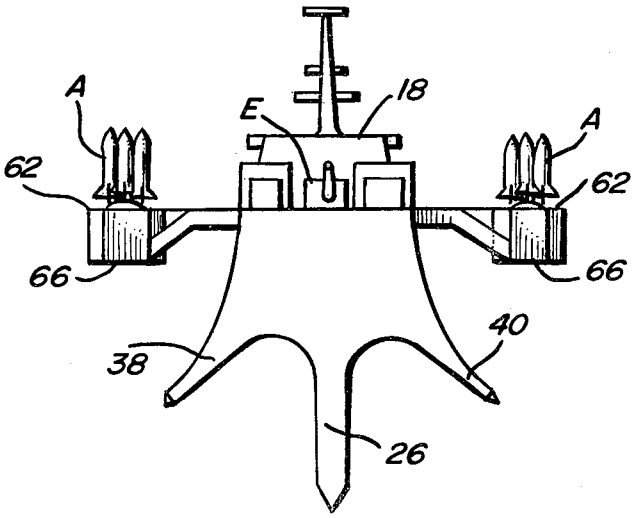
FIG. 4 is a rear elevational view of the hull.

From FIGS. 2, 3 and 4 of the drawings, it may be seen that the aft and forward portions of the upper marginal area of the sides 14 and 16 may be provided with outrigger-type platforms 62 and 64 supported in cantilever fashion outwardly of the sides 12 and 14 and that the platforms 62 and 64 may include various defensive or offensive armament weapons A and B. Further, the forward portion 66 of the superstructure 18 may include additional armament weapons C, the forward portion of the deck 36 may include further armament weapons D and the rear of the deck 36 may include still further armament weapons E. Also, the forward rear deck portion 68 may comprise a landing pad for aircraft such as helicopters.

From FIGS. 1 and 2 of the drawings, it may be seen that the Platforms 62 and 64 may include water planing undersurfaces 66 and 68 to assist in stability of the hull 10 while moving at high speed in heavy seas.

Inasmuch as the cutwaters 38 and 40 are inclinded downwardly and outwardly, listing of the hull 10 to one side increases the depth of the corresponding buoyant cutwater below the waterline 54 and raises the opposite cutwater 40 relative to the waterline 54. This, of course, will have the effect of reducing roll action of the hull 10. In addition, the depending keel 26 acts as a sail beneath the waterline 54 and strongly resists rolling movements of the hull 10. Also, the additional buoyancy provided by the lower aft portions of the keel 26 and the cutwaters 38 and 40 maintains the hull 10 substantially horizontal in a fore-and-aft direction while moving at speed and the depending fin 60 carried by the forward portion of the keel 26 resists pitching movements of the hull 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A high speed displacement-type hull including opposite longitudinal upstanding outer sides and a single central depending transversely narrow longitudinal keel, the forward end portions of said outer sides and keel being directed inwardly and upwardly, respectively, and merging together to form a forwardly tapering bow, the lower marginal portions of said sides, rearward of said bow, terminating minating downwardly in downwardly and equally oppositely outwardly inclined elongated longitudinally extending and transversely narrow displacement-type cutwaters whose outer lower marginal portions are substantially longitudinally straight and rearwardly, downwardly and outwardly inclined, said cutwaters including generally parallel inwardly and outwardly inclined outer and inner side surfaces extending longitudinally thereof and which are slightly inwardly and upwardly divergent, said keel, rearward of said bow, including a rearwardly and downwardly inclined lower extremity extending longitudinally of said hull throughout a major portion of the length of said hull rearward of said bow and upstanding opposite side surfaces spaced inwardly of said inner side surfaces of said cutwaters, and generally semi-cylindrical downwardly opening tunnel roof surfaces disposed on opposite sides of said keel and extending longitudinally of said hull bridging the upper marginal portions of the pairs of corresponding inner and outer side surfaces, the uppermost central portions of said tunnel roof surfaces extending longitudinally of said hull and being generally longitudinally straight, the included angle between said cutwaters being greater than 90° and said keel being centered and equally angularly spaced between said cutwaters, said hull including a static water line spaced above said roof surfaces and through which the forward end portions of said outer marginal portions of said cutwaters extend, at least major rear portions of the lower marginal portions of said cutwaters being disposed beneath said static water line, all longitudinally spaced portions of said keel being disposed at lower elevations than corresponding longitudinally spaced portions of said cutwaters.

2. The hull of claim 1 wherein the forward end portion of said keel rearward of said bow includes an integral depending buoyant fin portion.

3. The hull of claim 2 wherein said major portion of the length of said keel rearward of said bow is disposed rearward of said buoyant fin portion.

4. The hull of claim 1 wherein the lower marginal portions of said cutwaters and the lower extremity of said major portion of said keel are similarly rearwardly and downwardly inclined.

5. The hull of claim 4 wherein the forward end portion of said keel rearward of said bow includes an integral depending buoyant fin portion.

6. The hull of claim 1 including forward and aft opposite side cantilever supported downwardly facing water planing surfaces supported from and disposed outwardly of the upper marginal portions of said outer sides.

7. The hull of claim 1 wherein the aft end portion of said keel terminates downwardly a distance below the static waterline of said hull equal to approximately twice the distance the aft end portions of said cutwaters depend downwardly below said static water level.

8. The hull of claim 7 wherein the lowermost extremities of the aft ends of said cutwaters are disposed at a level equal approximate to the lower extremity of said keel immediately rearward of said bow.

9. The hull of claim 8 wherein the lower marginal portions of said cutwaters and the lower extremity of said major portion of said keel are similarly rearwardly and downwardly inclined.

* * * * *